US005480192A

United States Patent [19]

Angerbauer et al.

[11] Patent Number: 5,480,192

[45] Date of Patent: Jan. 2, 1996

[54] COUPON ORGANIZER

[76] Inventors: David G. Angerbauer; Rose H. Angerbauer, both of 3759 S. 2035 East, Salt Lake City, Utah 84109

[21] Appl. No.: 174,307

[22] Filed: Dec. 29, 1993

[51] Int. Cl.[6] ..... B42F 3/02

[52] U.S. Cl. ..... 281/31; 281/38; 402/79; 402/80 P; D19/33; 206/425; 40/124.2; 40/159

[58] Field of Search ..... 281/38, 31, 32; 402/79, 80 P; D19/33, 32; D3/35; D6/626; 383/39, 124.2; 40/159, 537, 405; 206/455, 472

[56] References Cited

U.S. PATENT DOCUMENTS

| | | | |
|---|---|---|---|
| D. 325,817 | 5/1992 | Call | D3/35 |
| 590,561 | 9/1897 | Baker | 281/22 X |
| 3,797,146 | 3/1974 | Holes . | |
| 4,004,690 | 1/1977 | Giarritta | 206/425 |
| 4,244,762 | 1/1981 | Holson | 40/124.2 X |
| 4,312,393 | 1/1982 | Green | 206/425 X |
| 4,344,242 | 8/1982 | Spees | 40/124.2 X |
| 4,345,394 | 8/1982 | Sullivan | 402/79 X |
| 4,356,649 | 11/1982 | Diamond et al. | 402/79 X |
| 4,629,070 | 12/1986 | Roberg | 402/79 X |
| 4,824,273 | 4/1989 | Silva et al. | 402/79 |
| 4,907,904 | 3/1990 | Baldwin | 402/79 X |
| 5,316,404 | 5/1994 | Hensel | 402/79 |

FOREIGN PATENT DOCUMENTS

| | | | |
|---|---|---|---|
| 537845 | 7/1941 | United Kingdom | 402/79 |

OTHER PUBLICATIONS

EZ2C Archival Photo Pages, The Professional Choice: EZ2C!, p. 40.

1989 Miller's Office Products Catalog, pp. 456, 459 and 461.

1989 Jacobs Gardner Office Products Catalog, pp. 423 and 424.

Carol Wright Gifts, *Shopper's Organizer*, 1993.

Carol Wright Gifts, *Grocery Coupon Organizer*, 1992.

Hannah Hansen, *Grocery Coupon Organizer*, no date.

Franklin Quest, *1993 Spring Catalog*., pp. 16, 25, 46, 48, 79, 80, 95, & 98.

*Primary Examiner*—Frances Han

*Attorney, Agent, or Firm*—Madson & Metcalf

[57] ABSTRACT

A coupon holder for efficiently organizing, storing, viewing and retrieving a variety of sizes of coupons. The holder includes a rectangular sheet of plastic including a tab, positioned along one edge, for attachment of the holder within a cover. Each sheet includes on its front and back face a first, second, third and fourth rectangular, transparent window, extending across substantially the entire width of the sheet. The windows are attached along their lower and lateral edges, with their upper edges unattached, thereby providing a pocket into which coupons may be placed. The first window is positioned within approximately the upper third of the front face of the sheet such that it covers less than the lower half of the upper third of the front face of the sheet. The second window is positioned within approximately the middle third of the front face of the sheet and the third and fourth window are positioned within approximately the lower third of the front face of the sheet.

18 Claims, 2 Drawing Sheets

COUPON ORGANIZER

BACKGROUND

1. The Field of the Invention

The present invention is related to a device for organizing, storing, viewing and retrieving "cents off" or discount shopping coupons. In particular, the present invention relates to a coupon holder which includes a plurality of transparent windows uniquely positioned on a plastic sheet for providing efficient access to coupons.

2. Technical Background

Many product manufacturers and retailers, particularly those selling grocery and other items which are typically marketed through supermarket or similar stores, offer discount coupons to consumers as an enticement to purchase specific products. Such coupons are circulated to consumers through a variety of means, most generally through newspapers and direct mail. Through the use of coupons, consumers are able to save substantial sums of money on their purchases.

The effective use of discount coupons generally requires significant time and effort on the part of the consumer. Not only must the consumer initially clip the coupons—which may number up to 100 each week—the coupons must be organized in some fashion. It will be appreciated that the accumulation of hundreds of discount coupons can be done fairly easily. In order to make "coupon shopping" reasonably efficient, a consumer must be able to quickly locate a specific coupon from the many that he or she may be carrying.

Consequently, many methods for holding and organizing coupons have been proposed to enable the consumer to locate a coupon for a particular item. One such method is to use several envelopes, with each envelope labeled with a different category of items, such as cereal, canned goods, household goods, etc. The consumer then organizes the coupons by placing each coupon in its appropriate envelope.

When the coupon is needed, the consumer can locate the envelope corresponding to the category of the item to be purchased and sort through the coupons in that envelope until the desired coupon is located. However, a significant disadvantage to this method is that, over time, a consumer may collect so many coupons for each category that it becomes time consuming and burdensome to sort through the coupons one at a time until the desired coupon is located.

Several variations on the "envelope" method have also been developed. These include small accordion-type books which include a divider or large pocket on each page for holding coupons. Generally, each divider or pocket is labeled according to a category. Such alternate methods suffer from the same disadvantages as using individual envelopes—coupons must generally be handled and viewed one at a time in order to locate and retrieve a particular coupon. Consequently, these methods cannot be used to quickly identify whether the consumer has a particular coupon and, even when the consumer knows that he or she has a particular coupon, such methods still require a substantial amount of time to locate the coupon.

From the foregoing, it can be seen that it would be an advancement in the art to provide a device for organizing and holding coupons which would enable a consumer to quickly determine whether he or she has a particular coupon.

It would also be an advancement in the art to provide such a device which would facilitate the task of locating a particular coupon which is believed to be in the consumer's possession.

It would be a further advancement in the art to provide such a device which could be used to organize and hold coupons in such a way as to accommodate the many combinations of various sized coupons which a consumer may collect.

Indeed, it would be an additional advancement if such a device were compact and could be easy to manufacture, thereby enabling it to be provided to the consumer at a low price.

Such a coupon organizer is disclosed and claimed herein.

BRIEF SUMMARY OF THE INVENTION

The present invention is directed to a novel coupon holder and organizer which may be carried in a cover, such as a three-ring binder. The coupon holder includes a flat, generally rectangular sheet of plastic having a front and a back face. It is presently preferred that the sheet be about 8.5 inches tall and about 6.5 inches wide.

Attached to each face of the sheet of plastic are a plurality of rectangular, transparent windows which extend across substantially the entire width of the sheet. The windows are attached to the sheet at their lower edge and at their lateral edges. The upper edge of the windows remains unattached to the sheet, thereby providing a pocket into which coupons may be placed. It is presently preferred that the number and positioning of windows on the back face of the sheet are the same as the number and positioning of the windows of the front face of the sheet.

Four windows are provided on each face of the plastic sheet. The windows are positioned with one window on each face located within the upper third of the sheet. In a preferred embodiment, these windows are positioned such that they cover less than the lower half of the upper third of the sheet.

One window on each face of the plastic sheet is positioned within approximately the middle-third of the sheet. The window in the middle third of the sheet is preferably configured to cover the entire lower half of the middle third of the sheet.

Finally, two windows of approximate equal size are provided on each face within the lower third of the sheet. The windows on the lower third of the sheet are configured such that one window covers the upper half of the lower third of the sheet with the other window positioned in the lower half of the lower third of the sheet, The windows are positioned on the sheet of plastic such that a lateral space is provided between adjacent windows, The lateral space facilitates the insertion and removal of coupons from the coupon holder. In a preferred embodiment, the lateral space between the lower three windows on each face of the plastic sheet is from about 0.25 to about 0.50 inches tall and extends along the entire width of the windows.

An elongate tab is positioned along one edge of the sheet for attachment of the holder to the cover, The tab preferably extends outwardly about 0.5 inches from the edge of the plastic sheet and includes three holes positioned to accommodate a cover having a three-ring binder mechanism, Thus, it is an object of the present invention to provide a device for organizing and storing coupons which would enable a consumer to quickly determine whether he or she has a particular coupon. It is an additional object of the invention to provide such a device which would facilitate the task of locating and retrieving a particular coupon which is believed to be in the consumer's possession. It is also an object of the present invention to provide a device which could be used to organize and hold coupons in such a way as to accommodate the many combinations of various sized coupons which a consumer may collect, It is a further object of the present invention to provide such a device which is compact and easy to manufacture, thereby enabling the device to be sold at a low price.

These and other objects and advantages of the present invention will become more fully apparent by examination of the following description of the preferred embodiments and the accompanying drawings.

BRIEF DESCRIPTION OF THE DRAWINGS

In order that the manner in which the above-recited and other advantages and objects of the invention are obtained may be understood, a more particular description of the invention briefly described above will be rendered by reference to the appended drawings. Understanding that these drawings only provide data concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
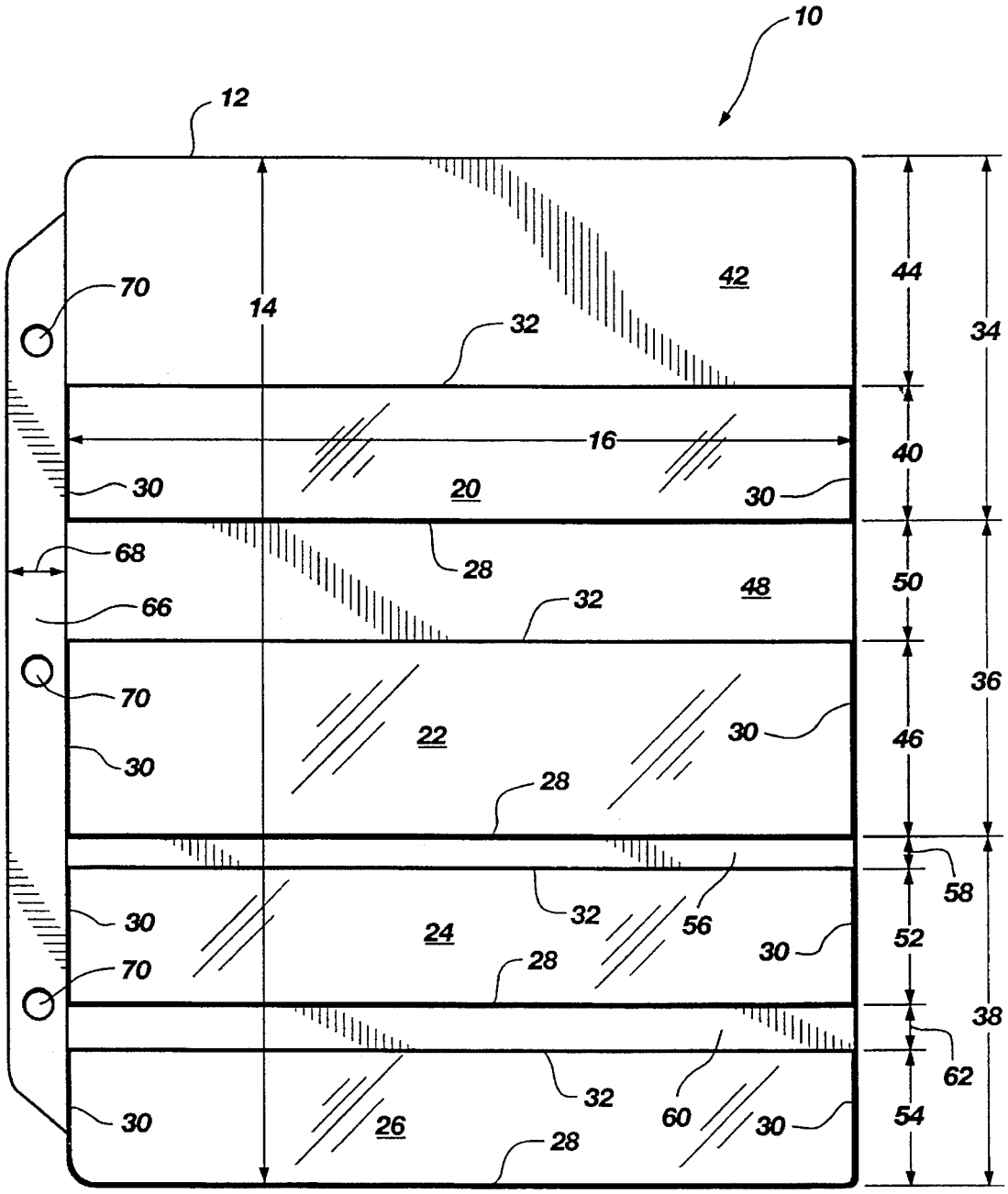
FIG. 1 is a side plan view of a preferred embodiment of a coupon holder made in accordance with the teachings of the present invention.

Reference is now made to the figures wherein like parts are referred to by like numerals throughout. With particular reference to FIG. 1, one preferred embodiment of a coupon holder of the present invention is generally designated at 10. The coupon holder 10 includes a plastic sheet 12. The plastic sheet 12 is preferably a flat, generally rectangular sheet of plastic having a front and a back face. In a presently preferred embodiment, the sheet 12 is made of an opaque plastic. The height 14 of the sheet 12 is preferably approximately 8.5 inches and the width 16 is approximately 6.5 inches.

The holder 10 further includes a plurality of transparent windows which are attached to each face of the sheet to provide pockets for holding coupons. As used herein, the term "transparent" includes translucent, the intent being to include within the scope of the invention any material used in the construction of the windows through which the identity of the coupons being held in the windows may be determined.

The windows are uniquely positioned on the sheet to provide for the efficient arrangement of coupons. Indeed, given the range of sizes and dimensions of coupons generally used in the industry, the placement of the windows has been carefully calculated to accommodate the numerous possible combinations of various coupons within any particular product category. In this preferred embodiment, the holder 10 includes four windows 20, 22, 24, and 26 attached to the front face of the sheet 12 and extend across the entire width 16 of the sheet. Corresponding windows (not shown) are similarly attached to the back face of sheet 12. The windows are attached to the sheet 12 at their lower edge 28 and at their lateral edges 30. The upper edge 32 of the windows remains unattached to the sheet, thereby providing a pocket into which coupons may be placed. The windows on the back face of the sheet 12 are placed in the same position as windows on the front face, such that the appearance and window configuration of the back face is substantially identical to that of the front face.

As illustrated in FIG. 1, the sheet 12 includes three sections, an upper third 34, a middle third 36 and a lower third 38. In this preferred embodiment, upper third 34 is 3.0 inches, middle third 36 is 2.625 inches and lower third 38 is 2.875 inches. One of skill in the art will appreciate that these dimensions may be modified while continuing to divide the sheet 12 into three generally equal sections, Window 20 is positioned within the upper third 34 of the sheet 12, window 22 is positioned within the middle third 36 of the sheet and windows 24 and 26 are positioned within the lower third 38 of the sheet 12. The windows are positioned on the sheet 12 such that a lateral space is provided between adjacent cent windows, thereby facilitating the insertion and removal of coupons from the coupon holder 10.

It is presently preferred that window 20 have a height 40 of 1.125 inches, leaving a lateral space 42 having a height 44 of 1.875 inches. Window 22 has a height 46 of 1.625 inches, leaving a lateral space 48 having a height 50 of 1.0 inches. Windows 24 and 26 have heights 52 and 54, respectively, which are each 1.125 inches, leaving a lateral space 56 above window 24 with a height 58 of 0.25 inches and a lateral space 60 above window 26 with a height 62 of 0.375 inches.

The holder 10 further includes means, positioned along an edge of the sheet 12, for attachment of the holder 10 to a cover (not shown). In this preferred embodiment, such means includes an elongate tab 66. The tab 66 has a width 68 of 0.5 inches and includes three holes 70 positioned to accommodate a cover having a three-ring binder mechanism.

The holder 10 is preferably made of conventional plastic sheeting. The windows are attached to the sheet 12 through a conventional heat seal process, such as is well known in the art. One of skill in the art will appreciate, however, that a variety of materials and construction may be employed to generate a holder 10 having the configuration of that disclosed and claimed herein.

The use of the coupon holder 10 is best illustrated with reference to FIGS. 2 through 5. The coupon holder 10 of the present invention is preferably used by combining several coupon holders in a cover, such as a three-ring binder. It has been found that sizing the coupon holders 10 as described with reference to FIG. 1 enables a cover having dimensions, when open, of approximately 19.75 by 9.125 inches to be used to organize several coupon holders 10. Importantly, a cover of such dimensions may conveniently be placed in the child seat of a conventional shopping cart, thereby enabling the consumer to have easy access to the coupon holders.

The coupon holders 10 may be separated into categories by the use of tabs or other indicia which are known in the art. Typical categories include: produce/deli, bakery/baking items, prepared/canned, cereal/breakfast, beverages/snacks, meats, dairy/refrigerated, cleaning, paper/plastic, health/beauty, frozen and misc. When searching for a coupon, the binder may be easily opened to the section corresponding to the category of interest. This generally exposes the front face of one coupon holder and the back face of the adjacent coupon holder. The many coupons held in the windows on those two exposed faces may then be simultaneously viewed by the consumer, making it easy to locate a particular coupon. In this manner, the need to separately handle and view coupons one at a time is eliminated.

Figure 2:
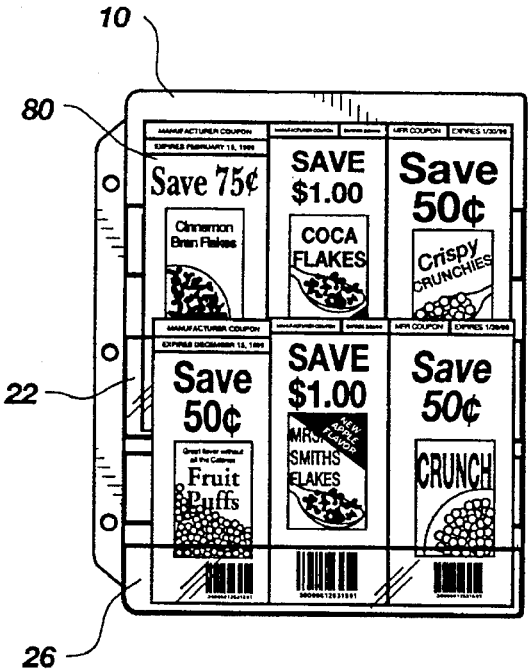
FIG. 2 is a side plan view of the coupon holder of FIG. 1 as it would be used to hold a variety of tall coupons.

Although coupons come in a variety of sizes, one particularly common size is about 5.25 by 2.25 inches. Such "tall" coupons 80 having these dimensions may be efficiently organized in the coupon holder 10, as illustrated in FIG. 2, by placing them in window 22 and window 26. Thus, six tall coupons 80 may be positioned on one face of the coupon holder 10.

Figure 3:
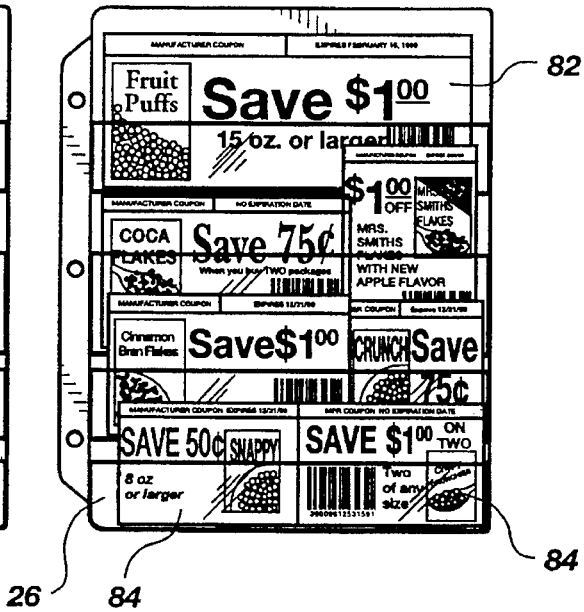
FIG. 3 is a side plan view of the coupon holder of FIG. 1 as it would be used to hold medium and short coupons.

Another typical size of coupon has the same general dimensions as the tall coupons 80 of FIG. 2, but are oriented in the opposite direction, such as coupon 82 of FIG. 3. Such coupons may be easily viewed by positioning them in window 20, as illustrated in FIG. 3. Short coupons, such as coupons 84 may be placed in window 26, leaving windows 20, 22 and 24 for other coupons.

Figure 4:
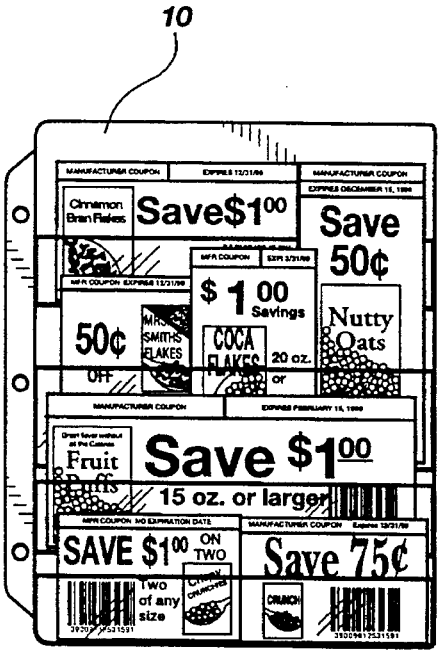
FIGS. 4 and 5 are side plan views of the coupon holder of FIG. 1 as they would be used to hold coupons having a variety of sizes.
Figure 5:
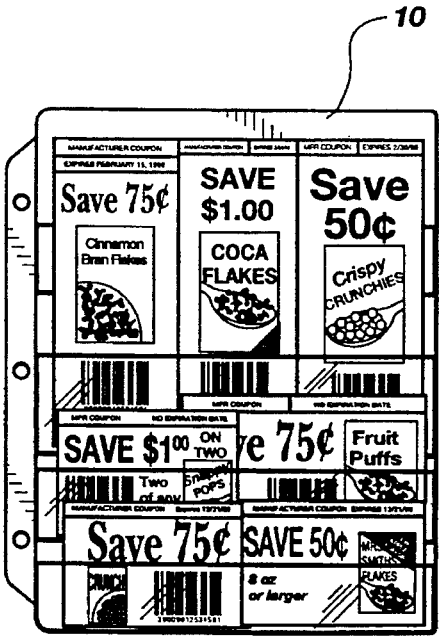

FIGS. 3 through 5 illustrate how the coupon holder 10 of the present invention may be effectively used to organize and display coupons having a variety of shapes. To further increase the number of coupons which may be displayed on the face of the coupon holder 10, the coupons may be overlapped-and folded so that just the product, amount and expiration date of each coupon can be seen. By trimming each coupon to the dotted line, the density of coupons on each coupon holder may be further increased. Moreover, if the consumer has several coupons for the product, those coupons may be stored behind each other with the coupon having the earliest expiration date placed in front.

Generally, each face of the holder 10 will hold from four to nine coupons. Of course, the consumer may experiment to determine the most efficient arrangement for his or her own collection of coupons. Importantly, the novel positioning of the windows 20, 22, 24 and 26 enable the wide variety of sizes of coupons to be organized such that many coupons may be displayed on a single coupon organizer, thereby avoiding having to search through coupons individually as is required by prior art devices.

From the foregoing it can be seen that the present invention provides a novel device for organizing and storing coupons which enables a consumer to quickly determine whether he or she has a particular coupon. Even when the consumer knows he or she has a particular coupon, the coupon holder of the present invention greatly facilitates the task of locating and retrieving that coupon.

Because of the novel configuration of the windows of the coupon holder, the present invention provides a means for holding and organizing coupons which is particularly compact. Its simple construction and the materials used to make the coupon holder enable it to be manufactured at a low cost, thereby permitting it to be sold to the consumer at a low price.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by,the appended claims rather than by the foregoing description. All changes which come within the meaning and range of equivalency of the claims are to be embraced within their scope.

What is claimed and desired to be secured by patent is:

1. A coupon holder for carrying rectangular coupons of various predetermined sizes and which may be carried in a cover, comprising:

a flat, generally rectangular sheet of plastic having a front face and a back face;

attachment means positioned along an edge of the sheet; and a plurality of pockets capable of holding the coupons, each pocket comprising a rectangular, transparent window attached to the front face of the sheet, each window extending across substantially the entire width of the front face of the sheet, wherein a first window is positioned within approximately the upper third of the front face of the sheet, a second window is positioned within approximately the middle third of the front face of the sheet and a third and a fourth window are positioned within approximately the lower third of the front face of the sheet such that the coupons may be located within the windows in an overlapping fashion thereby permitting certain information on the coupons to be exposed, the third and the fourth window being of approximate equal size, the windows being positioned on the sheet such that a lateral space is provided between adjacent windows thereby facilitating the insertion and removal of the coupons, and wherein each of the windows has a lower edge and two lateral edges which are attached to the sheet, and an upper side which is unattached to the sheet, thereby providing a pocket into which the coupons may be placed.

2. A coupon holder as defined in claim 1, further comprising:

a plurality of rectangular, transparent windows attached to the back face of the sheet, each window extending across substantially the entire width of the back face of the sheet, wherein a fifth window is positioned within approximately the upper third of the back face of the sheet, a sixth window is positioned within approximately the middle third of the back face of the sheet and a seventh and an eighth window, being of approximate equal size, are positioned within approximately the lower third of the back face of the sheet, and wherein each of the windows has a lower edge and two lateral edges which are attached to the sheet, and an upper side which is unattached to the sheet, thereby providing a pocket into which coupons may be placed.

3. A coupon holder as defined in claim 2, wherein the positioning of the windows on the front face of the sheet is substantially the same as the positioning of the windows on the back face of the sheet.

4. A coupon holder as defined in claim 1, wherein the third window is positioned in the upper half of the lower third of the front face of the sheet and the fourth window is positioned in the lower half of the lower third of the front face of the sheet.

5. A coupon holder as defined in claim 1, wherein first window covers less than the lower half of the upper third of the front face of the sheet.

6. A coupon holder as defined in claim 1, wherein the second window covers the entire lower half of the middle third of the front face of the sheet.

7. A coupon holder for carrying rectangular coupons of various predetermined sizes and which may be carried in a cover, comprising:

a flat, generally rectangular sheet of plastic having a front face and a back face;

attachment means positioned along an edge of the sheet; and a plurality of rectangular, transparent windows attached to the front face of the sheet, each window extending across substantially the entire width of the front face of the sheet, wherein a first window having a height of about 1.125 inches is positioned within approximately the upper third of the front face of the sheet such that it covers less than the lower half of the upper third of the front face of the sheet, a second window having a height of about 1.625 inches is positioned within approximately the middle third of the front face of the sheet and a third and a fourth window each having a height of about 1.125 inches are positioned within approximately the lower third of the front face of the sheet, wherein the third window is positioned in the upper half of the lower third of the front face of the sheet and the fourth window is positioned in the lower half of the lower third of the front face of the sheet, the third and the fourth window being of approximately equal size; and a plurality of rectangular, transparent windows attached to the back face of the sheet, each window extending across substantially the entire width of the back face of the sheet, wherein a fifth window is positioned within approximately the upper third of the back face of the sheet such that it covers less than the lower half of the upper third of the back face of the sheet, a sixth window is positioned within approximately the middle third of the back face of the sheet and a seventh and an eighth window, being of approximate equal size, are positioned within approximately the lower third of the back face of the sheet, wherein the fifth window is positioned in the upper half of the lower third of the back face of the sheet and the sixth window is positioned in the lower half of the lower third of the back face of the sheet, wherein each of the windows has a lower edge and two lateral edges which are attached to the sheet, and an upper side which is unattached to the sheet, thereby providing a pocket into which the coupons may be placed such that the coupons may be located within the windows in an overlapping fashion thereby permitting certain information on the coupons to be exposed, and wherein each of the windows is positioned on the sheet such that a lateral space is provided between adjacent windows thereby facilitating the insertion and removal of the coupons.

8. A coupon holder as defined in claim 7, wherein the positioning of the windows on the front face of the sheet is substantially the same as the positioning of the windows on the back face of the sheet.

9. A coupon holder as defined in claim 7, wherein the second window covers the entire lower half of the middle third of the front face of the sheet and the sixth window covers the entire lower half of the middle third of the back face of the sheet.

10. A coupon holder as defined in claim 7, wherein the lateral space between the second and the third windows, between the third and fourth windows, between the sixth and seventh windows, and between the seventh and eighth windows is from about 0.25 to about 0.50 inches tall and extends along the entire width of the windows.

11. A coupon holder as defined in claim 7, wherein the height of the sheet is about 8.5 inches.

12. A coupon holder as defined in claim 7, wherein the sheet is about 6.5 inches wide.

13. A coupon holder as defined in claim 7, wherein the means for attachment of the holder to the cover comprises an elongate tab including three holes positioned to accommodate a cover having a three-ring binder mechanism.

14. A coupon holder as defined in claim 13, wherein the elongate tab extends outwardly about 0.5 inches from the edge of the sheet.

15. A coupon holder for carrying rectangular coupons of various predetermined sizes and which may be carried in a cover, comprising:

a flat, generally rectangular sheet of plastic having a front face and a back face;

an elongate tab positioned along an edge of the sheet, the elongate tab including three holes positioned to accommodate a three-ring binder mechanism;

a first, second, third and fourth rectangular, transparent window attached to the front face of the sheet, each window extending across substantially the entire width of the front face of the sheet, each window providing a pocket into which coupons measuring about 5.25 inches by about 2.25 inches may be held, wherein the first window is positioned within approximately the upper third of the front face of the sheet such that it covers less than the lower half of the upper third of the front face of the sheet, the second window is positioned within approximately the middle third of the front face of the sheet and the third and fourth window are positioned within approximately the lower third of the front face of the sheet such that the coupons may be located within the windows in an overlapping fashion thereby permitting certain information on the coupons to be exposed, wherein the second window covers the entire lower half of the middle third of the front face of the sheet, and wherein the third window is positioned in the upper half of the lower third of the front face of the sheet and the fourth window is positioned in the lower half of the lower third of the front face of the sheet, the third and fourth window being of approximately equal size; and a fifth, sixth, seventh and eighth rectangular, transparent window attached to the back face of the sheet, the fifth, sixth, seventh and eighth windows corresponding in size and relative position to the first, second, third and fourth windows, respectively, such that the positioning of windows on the back face of the sheet is the same as positioning of the windows on the front face of the sheet, wherein each of the windows has a lower edge and two lateral edges which are attached to the sheet, and an upper side which is unattached to the sheet, thereby providing a pocket into which the coupons may be placed, and wherein each of the windows is positioned on the sheet such that a lateral space is provided between adjacent windows thereby facilitating the insertion and removal of the coupons.

16. A coupon holder as defined in claim 15, wherein the lateral space between the second and the third windows, between the third and fourth windows, between the sixth and seventh windows, and between the seventh and eighth windows is from about 0.25 to about 0.50 inches tall and extends along the entire width of the windows.

17. A coupon holder as defined in claim 15, wherein the sheet is about 8.5 inches tall and about 6.5 inches wide.

18. A coupon holder as defined in claim 15, wherein the elongate tab extends outwardly about 0.5 inches from the edge of the sheet.

* * * * *